US006742772B2

(12) United States Patent
Kiefer

(10) Patent No.: US 6,742,772 B2
(45) Date of Patent: Jun. 1, 2004

(54) CARBONATING DEVICE

(75) Inventor: Rainer Kiefer, Maintal (DE)

(73) Assignee: Soda-Club ($CO_2$) Atlantic GmbH, Zug (CH)

( * ) Notice: Subject to any disclaimer, the term of this patent is extended or adjusted under 35 U.S.C. 154(b) by 54 days.

(21) Appl. No.: 10/149,201

(22) PCT Filed: Dec. 7, 2000

(86) PCT No.: PCT/EP00/12332

§ 371 (c)(1),
(2), (4) Date: Oct. 21, 2002

(87) PCT Pub. No.: WO01/41907

PCT Pub. Date: Jun. 14, 2001

(65) Prior Publication Data

US 2003/0075813 A1 Apr. 24, 2003

(30) Foreign Application Priority Data

Dec. 11, 1999 (DE) ..... 199 59 770

(51) Int. Cl.[7] ..... B01F 3/04

(52) U.S. Cl. ..... 261/65; 261/121.1; 261/DIG. 7; 99/323.1; 426/477

(58) Field of Search ..... 261/64.1, 65, 74, 261/77, 121.1, DIG. 7; 99/323.1, 323.2; 426/474, 477

(56) References Cited

U.S. PATENT DOCUMENTS

| | | | | |
|---|---|---|---|---|
| 3,953,550 A | * | 4/1976 | Gilbey | 261/64.3 |
| 4,082,123 A | * | 4/1978 | Haythornthwaite et al. | 141/64 |
| 4,304,741 A | * | 12/1981 | Avison et al. | 261/121.1 |
| 4,395,940 A | * | 8/1983 | Child et al. | 99/323.1 |
| 4,401,016 A | | 8/1983 | Adams et al. | |
| 4,401,607 A | * | 8/1983 | Child et al. | 261/121.1 |
| 4,422,371 A | * | 12/1983 | Child et al. | 99/323.1 |
| 4,610,282 A | * | 9/1986 | Brooks et al. | 141/46 |
| 5,118,010 A | * | 6/1992 | Jeans | 222/3 |
| 5,209,378 A | | 5/1993 | Wiseburgh et al. | |

* cited by examiner

*Primary Examiner*—Scott Bushey
(74) *Attorney, Agent, or Firm*—Dinsmore & Shohl LLP

(57) ABSTRACT

The invention relates to a carbonating device for charging a liquid with a pressurized gas. Carbonating devices of this type are generally used for adding carbon dioxide or $CO_2$ to tap water or so-called still water. According to the invention, the pivotal filling device can be locked into a so-called pivotal position in a manner that makes the inventive carbonating device easier to handle than commercially available carbonating devices. The invention provides that the pivotal filling device can be firstly brought into the pivotal position and locked in place by using one hand. Afterwards, the water bottle can be clamped or screwed onto the filling device by using both hands. Together with the water bottle, the filling device is then released from its locked position and placed into the so-called filling position.

19 Claims, 7 Drawing Sheets

CARBONATING DEVICE

Figure 1:
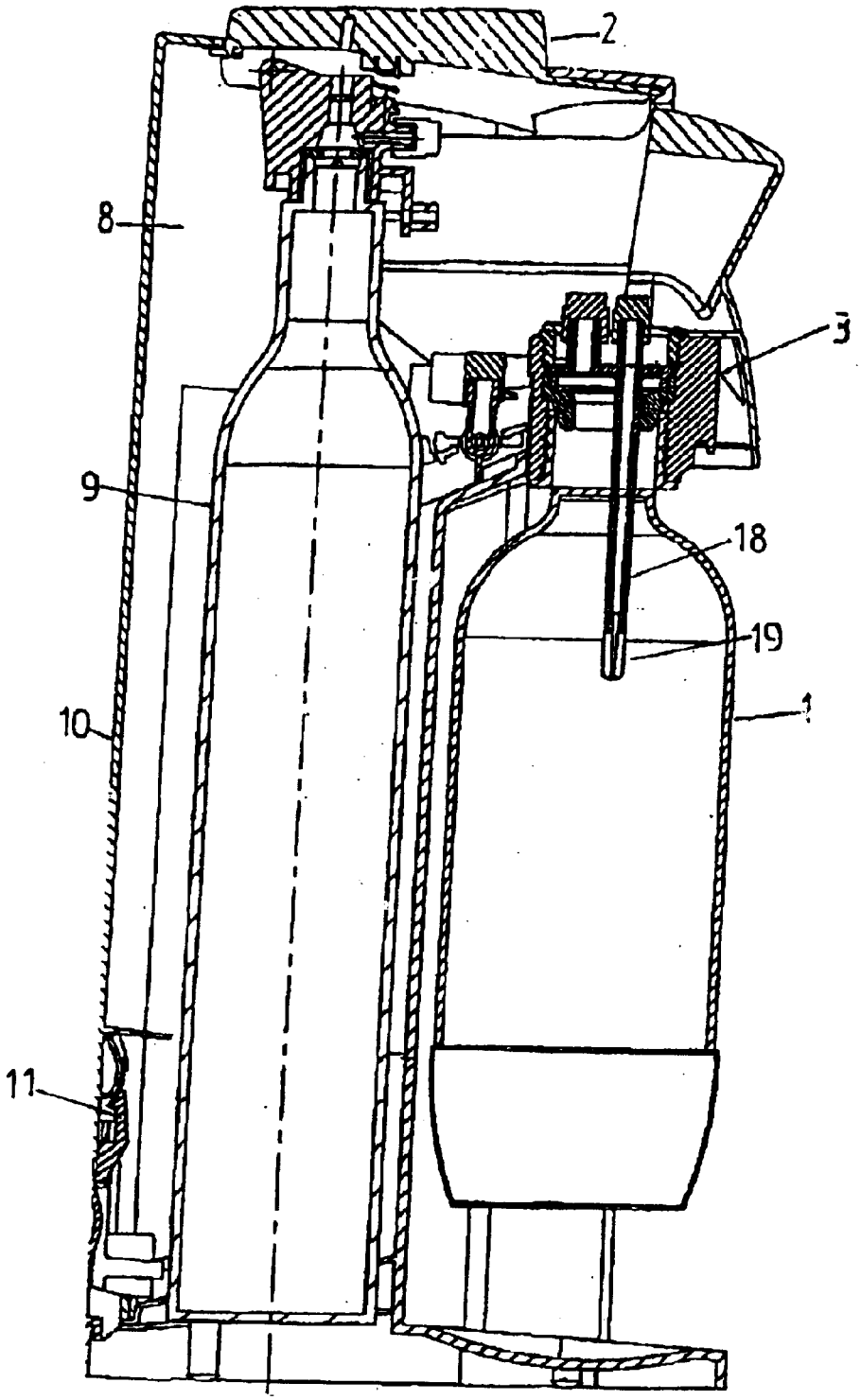

The present invention relates to a carbonating device for loading a liquid with a pressurized gas. Such carbonating devices usually serve to mix tap water or so-called still water with carbon dioxide or $CO_2$. By using such a carbonating device, the arduous carrying of drinks crates can be significantly reduced in particular in areas in which the tap water is safe to drink. Suitable additives such as e.g. syrups are now available on the market, so that with the help of the carbonating device, the most varied non-alcoholic drinks can be prepared and mixed with carbon dioxide.

Carbonating devices generally have a filling device which can be connected sealed off to a vessel containing the liquid, the filling device having a filling valve and actuation elements for this purpose, with which the connection between the inside of the vessel and the pressurized section of the filling device can be established. In order e.g. to make water into a sparkling, carbonated drink, a vessel filled with water is connected sealed off to the filling device. The filling valve is then opened by means of the actuation elements and the water-filled vessel is pressurized in a carbon-dioxide atmosphere. Naturally, a pressure container filled with carbon dioxide must be connected to the carbonating device for this purpose. The solubility of carbon dioxide in water is relatively high and increases linearly with the pressure as the pressure rises at room temperature at low pressures up to approx. 10 bar. Thus e.g. at room temperature and approx. 4 bar pressure, approx. 4 standard liters $CO_2$ gas dissolve in one liter of water (a standard liter represents a gas volume of 1000 $cm^3$ under so-called standard conditions, i.e. at room temperature and atmospheric pressure). Sometimes, carbon dioxide also forms in the water, breaking down into water and $CO_2$ when the pressure is relieved, the $CO_2$ gasses out from the water and causes the beading of gas bubbles generally known of carbonated drinks.

A large number of such carbonating devices are now available on the market. Despite the many undisputed advantages of such carbonating devices, the customary carbonating devices nevertheless have a whole range of disadvantages.

Thus the devices available on the market as a rule have a housing into which a corresponding water bottle can be inserted. In addition, the filling device is often swivellable in order to be able to establish the connection to a bottle neck while in a swivelled position and to then swivel the bottle towards the device so that the bottles can be filled with carbon dioxide in this filling position. This swivellable filling device has the disadvantage however that it is difficult to handle. Thus the filling device must be brought into the swivelled position with one hand and the water bottle placed onto the filling device with the other hand. During this screwing and/or clamping process of the water bottle onto the filling device, it is necessary to leave the filling device in the swivelled position so that one of the user's hands must continuously hold the filling device. However, the water bottle can often be connected to the filling device or detached therefrom with the other hand alone only with difficulty.

The object of the present invention is therefore to create a carbonating device which is easier to handle compared with the carbonating devices customary on the market.

This object is achieved according to the invention in that the swivellable filling device can be locked in the first position, the so-called swivelled position. This makes it possible to first bring the swivellable filling device into the first position and lock it with one hand. Then the water bottle can be clamped or screwed onto the filling device using both hands. Only then is the filling device together with the water bottle unlocked again and brought into the second position, the so-called filling position.

A particularly advantageous version provides that the filling device is preferably elastically pre-tensioned into the second position. This ensures that the user always brings the swivellable filling device fully into the first position as it engages only there. An inadvertent swivelling back of the filling device while the user wants to connect the water bottle to the filling device is thus ruled out.

A particularly expedient version of the present invention provides that at least one device is provided which in the first position of the filling device prevents the actuation of the actuation elements of the valve and/or in the second position of the filling device prevents the connection or detachment of the vessel to or from the filling device. These two measures which can be carried out alternatively or in combination with each other are particularly advantageous for safety reasons. Because, in the first position of the filling device, the actuation of the actuation elements of the valve is prevented, an inadvertent gassing of the liquid during the attaching of the bottle to the filling device can be effectively prevented. The second measure, that in the second position of the filling device the connection or detachment of the vessel to or from the filling device is prevented, ensures that during the gassing, an inadvertent detachment of the water bottle from the filling device is not possible.

In addition, the carbonating devices customary in the trade generally have a rear space which serves to house a pressure container, e.g. a gas bottle, in which the gas to be dissolved in the liquid is stored under pressure. For optical and sometimes also safety reasons, the rear space is sealed by a rear part. However, as the pressure container is to be replaced by the user as required, it is essential for the user to have access to the rear space as required. The rear part can therefore be removed from the rear space in the commercially available carbonating devices. As the rear parts of the known carbonating devices are generally manufactured using an injection-moulding process with the help of a single-impression mould, the removal of the rear part from the carbonating device often proves very difficult. Thus carbonating devices exist in which the rear part must be deformed with one hand in order that it can be detached from the carbonating device. For the most part, this is possible only by expending considerable force.

The ease of handling of the carbonating device according to the invention can therefore be improved still further in that the rear space which [serves] to house a pressure container in which the gas to be dissolved in the liquid is stored under pressure can be sealed by a rear part with the help of a locking device, the locking device having a movable part which is attached to the rear part and the movable part having a first position in which the locking device is closed and a second position in which the locking device is open, the locking device preferably not being pre-tensioned into the first position.

The rear part can thereby now be very easily detached from the rear space. To this end, the user must bring the movable part from the first position into the second position. The rear part can then be detached from the carbonating device. After the pressure container has been replaced, the rear part is then fitted anew onto the carbonating device or the rear space and the locking device brought from the second position into the first position. Because the locking device is not pre-tensioned into the first position, it is guaranteed that the locking device can first be brought into the second position and then, without the locking device having to be held fast in the second position, the rear part can be removed.

Preferably, the movable part of the locking device is essentially a bar or slide which in the lok-ked position engages behind a wall or in the base of the rear space.

It goes without saying that the described locking device can also be used in carbonating devices which have no swivellable part of the filling device which can be locked in the first position.

A further disadvantage of the known carbonating devices is that in most cases blow-off or pressure-relief valves are provided which are intended to lower the internal pressure in the vessel upon detachment of the vessel or the water bottle from the filling device. To this end, the pressure built up over the liquid is abruptly released into the atmosphere. In particular if the carbonating device is not only to be used to enrich water with carbon dioxide, but syrups are also to be added, a not inconsiderable foaming may occur during the gassing of the liquid. If the blow-off valve is now opened upon detachment of the vessel from the filling device, a gas-liquid mixture escapes to the outside. In order that the user is not sprayed, the blow-off valves are generally arranged such that they conduct the excess pressure into a function space within the carbonating device. As this function space can be accessed only with difficulty, it can as a rule be cleaned by the user only with difficulty, so that mould can form with prolonged use of the carbonating device, in particular for the gassing of liquids containing syrups. Because the function space can be accessed only with difficulty and cannot be inspected from outside, an unhygienic atmosphere can develop in the function space in rare cases. Although this has no effects whatsoever on the quality of the gassed drink, this state of affairs is nevertheless undesirable.

A particularly expedient version of the present invention therefore provides that the carbonating device has at least one blow-off valve which, when the vessel is connected to the filling device, can then connect the inside of the vessel to the outside, at least one blow-off valve opening when the filling device passes from the first position into the second position. A version in which at least one blow-off valve is operated by moving sliding blocks when the filling device passes from the first into the second position is particularly expedient. It is thereby possible to mount the valves securely such that the valves are less problem-prone and the position of the valve outlet is clearly defined. Preferably at least one blow-off valve is simultaneously a pressure-relief valve which opens automatically when the internal pressure in the vessel exceeds a pre-specified value. An additional pressure-relief valve can thus be dispensed with.

For safety reasons, it is nevertheless expedient that at least two pressure-relief valves are provided so that, if one pressure-relief valve fails, a second still prevents a bursting of the vessel which would otherwise be possible.

A version is particularly preferred in which at least two pressure-relief valves are opened when the filling device passes from the first into the second position, so that they serve as blow-off valves. This ensures that the pressure-relief valves are opened and closed at least once during every gassing process, so that a sticking of the pressure-relief valves, which often occurs with valves which have not been used for a long time, is effectively prevented.

An expedient version of the present invention provides that the pressure-relief valves are arranged such that, through them, the inside of the vessel can be connected to the rear space of the device. This ensures that the gas-liquid mixture possibly present in the vessel is blown off into the readily accessible rear space so that the carbonating device can easily be cleaned and any fouling becomes obvious at the latest when replacing the pressure container.

A version is particularly favourable in which a collecting device is provided for the gas-liquid mixture emerging from the blow-off or pressure-relief valves under certain circumstances. This ensures that any fouling takes place at a previously defined location. If this location is visible to the user, e.g. if the collecting device is housed inside the space provided for the pressure bottle, the carbonating device is very easy to clean by regular cleaning of the collecting device.

For particular uses, it can be advantageous if the collecting device is removable from the carbonating device. Thus, in particular in the case of frequent gassing of syrup-containing liquids where increased foaming occurs and thus an increased amount of liquid emerges from the blow-off or pressure-relief valve, the collecting device can easily be removed and emptied. In particular if the carbonating device is intended to be moved frequently, it is also advantageous if the collecting device is essentially secured against horizontal movement. This ensures that, even when the carbonating device is temporarily held or stored in a non-vertical position, the collecting device does not fall over in the carbonating device. A version in which each blow-off or pressure-relief valve is provided with its own collecting device is particularly economical on space.

It goes without saying that the described arrangement of the blow-off valves or pressure-relief valves optionally with the collecting device can also be used in carbonating devices which have no swivellable part of the filling device which can be locked in the first position. The described arrangement, both on its own and in combination with the lockable swivellable filling device and/or the locking device of the rear part, makes for easier handling.

In general, adequately compression-resistant plastic bottles are used as vessel or water container. However, these plastic bottles have the disadvantage that after prolonged use they display material fatigue which can develop very rapidly, in particular if cleaning is carried out at too high a temperature. The plastic bottle then loses its compression resistance, so that the plastic bottle can burst during gassing.

To increase the burst-resistance of the vessels used, another improved version provides that, in the volume which is formed by the vessel and parts of the filling device in the sealed-off state, a bursting disk or a predetermined fracture point is provided. If the pressure in the vessel increases too markedly during the gassing process, so that the vessel is in danger of bursting, the predetermined fracture point or the bursting disk serves to provide a sudden escape of the excess pressure at a controlled point. In normal use, the pressure-relief valves perform this task. Should the latter however be limited in their function, e.g. for reasons of material fatigue, the bursting disk or the predetermined fracture point serves as an additional security.

One possibility is that the vessel has a predetermined fracture point which is preferably arranged in the area of the vessel neck near the filling opening. This version has the advantage that, should this additional safety device prove necessary, only the vessel must be replaced. Because the predetermined fracture point is arranged near the vessel neck, it is ensured that the liquid does not escape if the vessel breaks.

Alternative versions provide that a bursting disk is provided in the connection part or the connection tube between filling device and blow-out or pressure-relief valve or in the base of the filling device. A further version according to the invention of the carbonating device provides that the filling device has a nozzle which projects into the vessel during the gassing of the liquid, the nozzle or at least the nozzle head being removable from the filling device. It has been shown that the speed of the gassing also depends on the shape of the nozzle head. Through the removable nozzle or the removable nozzle head, it is thus possible to exchange nozzle or nozzle head if a different geometry of the nozzle head is desirable. In addition, if blockages occur in the region of the nozzle head during use, this can be cheaply exchanged without the whole carbonating device, or that part of the carbonating device which is connected sealed off to the vessel, having to be replaced.

It goes without saying that the described improvements (lockable swivellable filling device, locking device of the rear part, arrangement of the blow-off valves or pressure-relief valves optionally with the collecting device, bursting disk or predetermined fracture disk and removable nozzle or nozzle head) each on its own already makes for easier handling of the carbonating device. However, versions which realize as many of the described improvements as possible are preferred.

Further advantages, features and possible uses of the present invention become clear by means of the following description of a preferred version and the associated figures.

Figure 2:
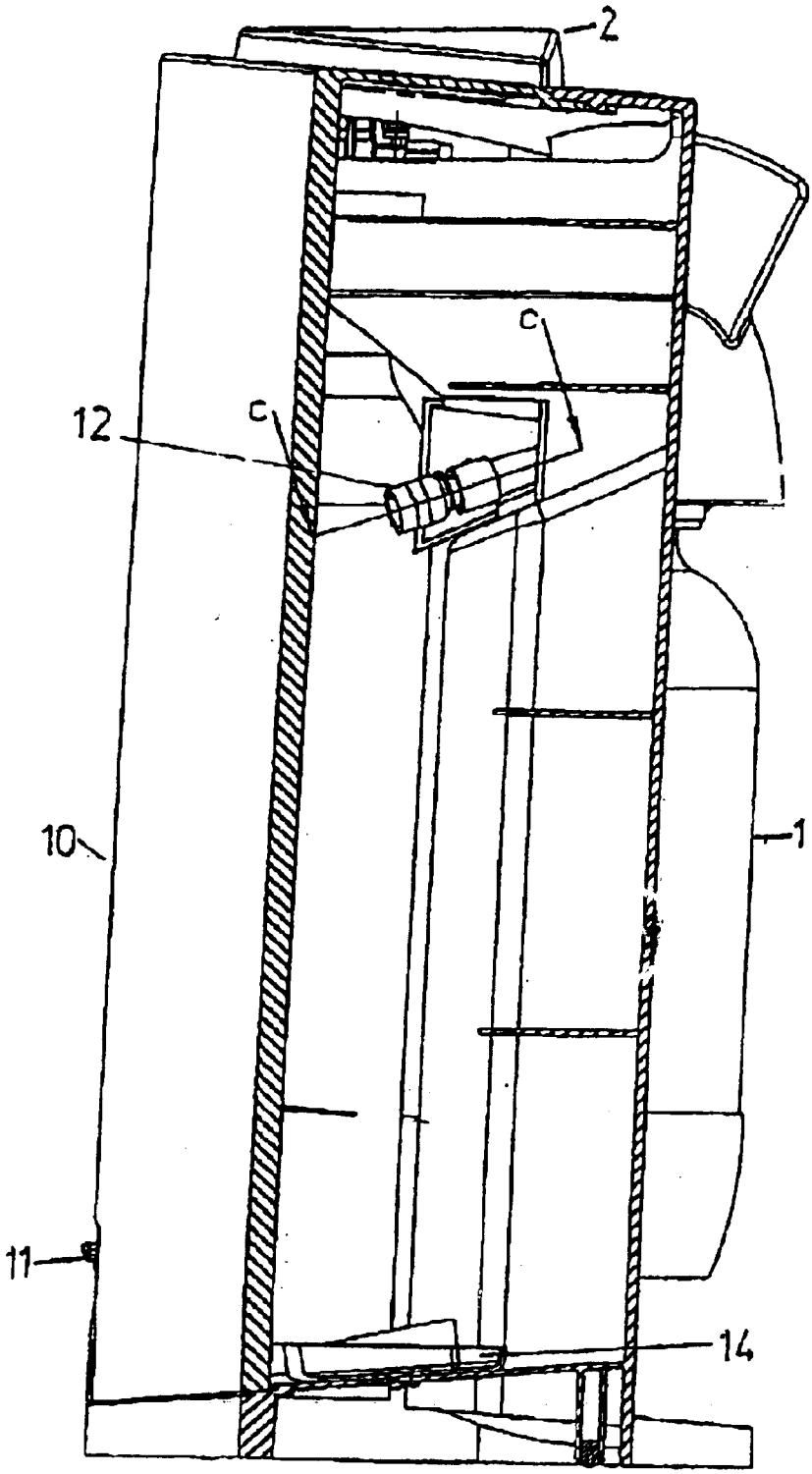
Figure 3A:
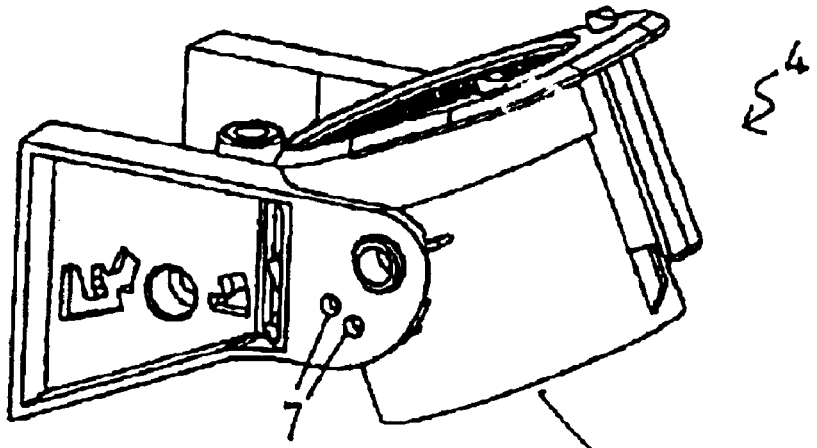
Figure 3B:
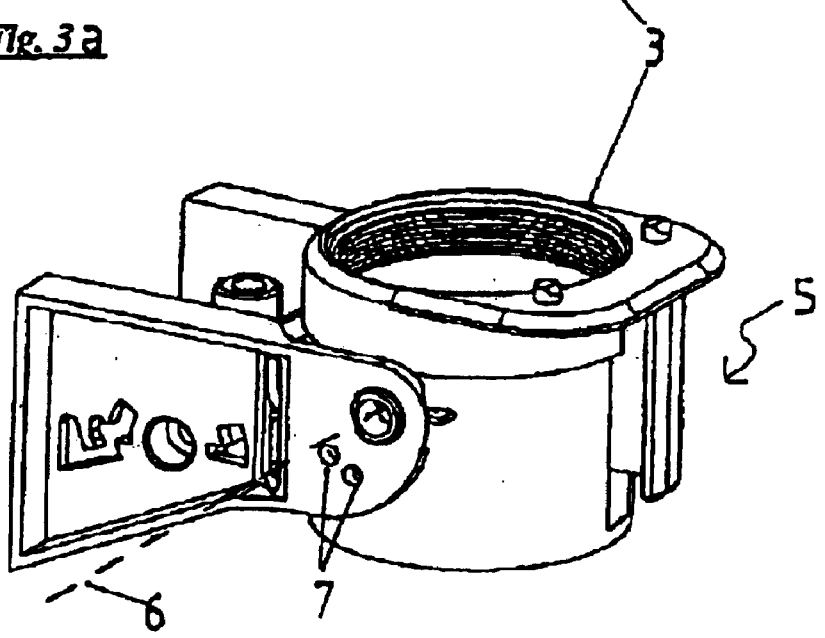
Figure 4:
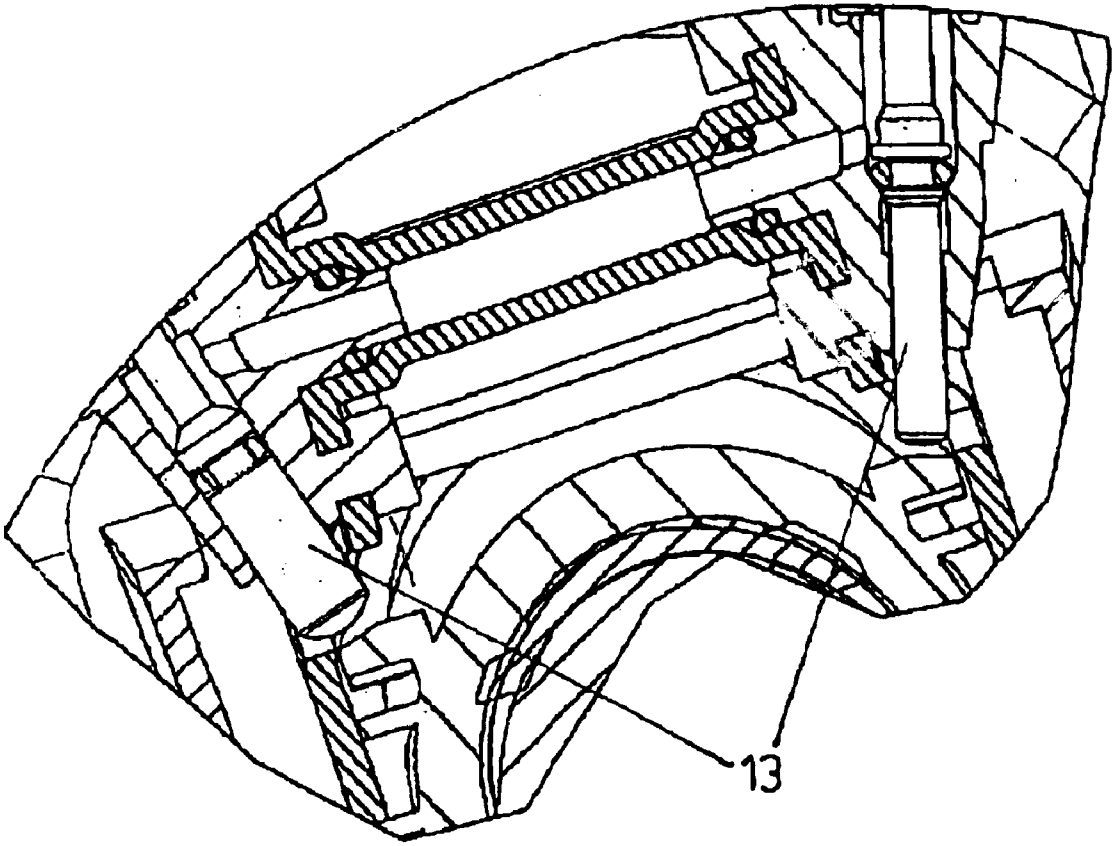
Figure 5:
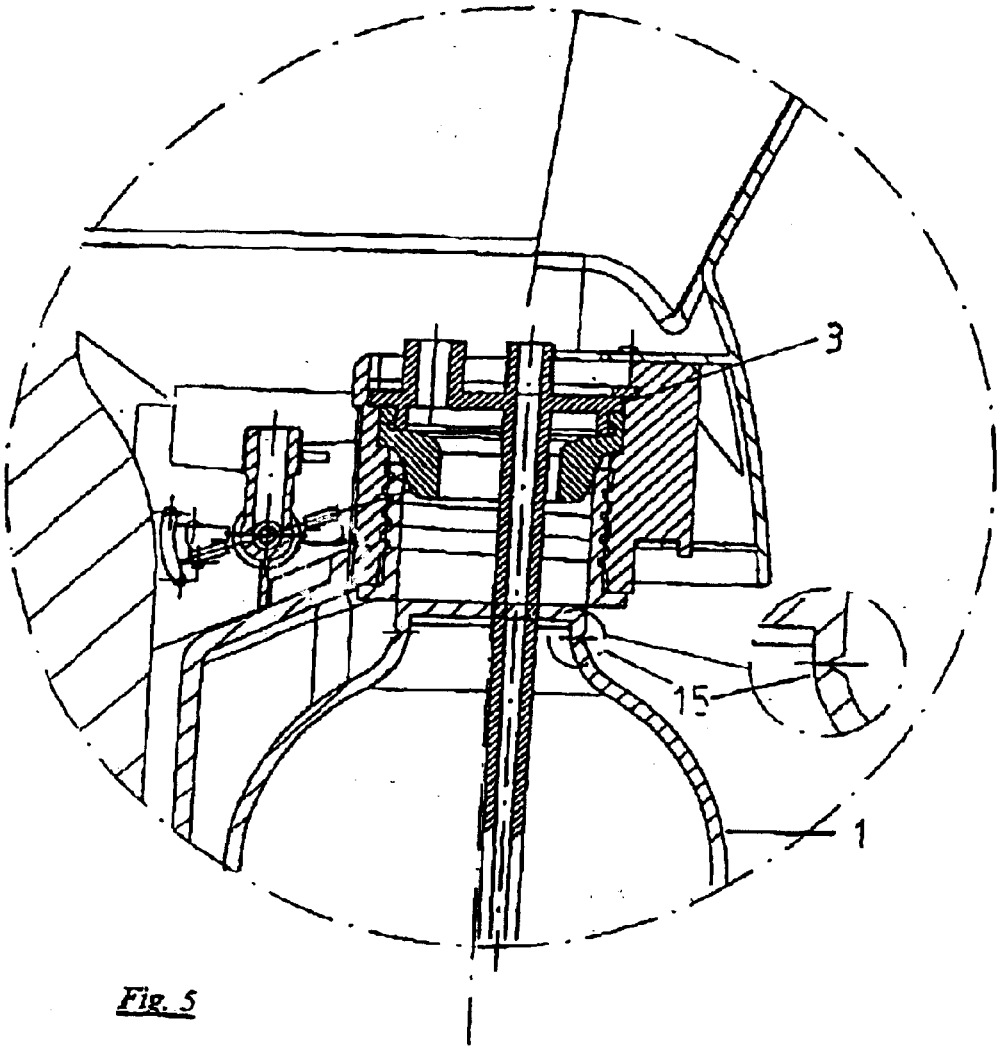
Figure 6:
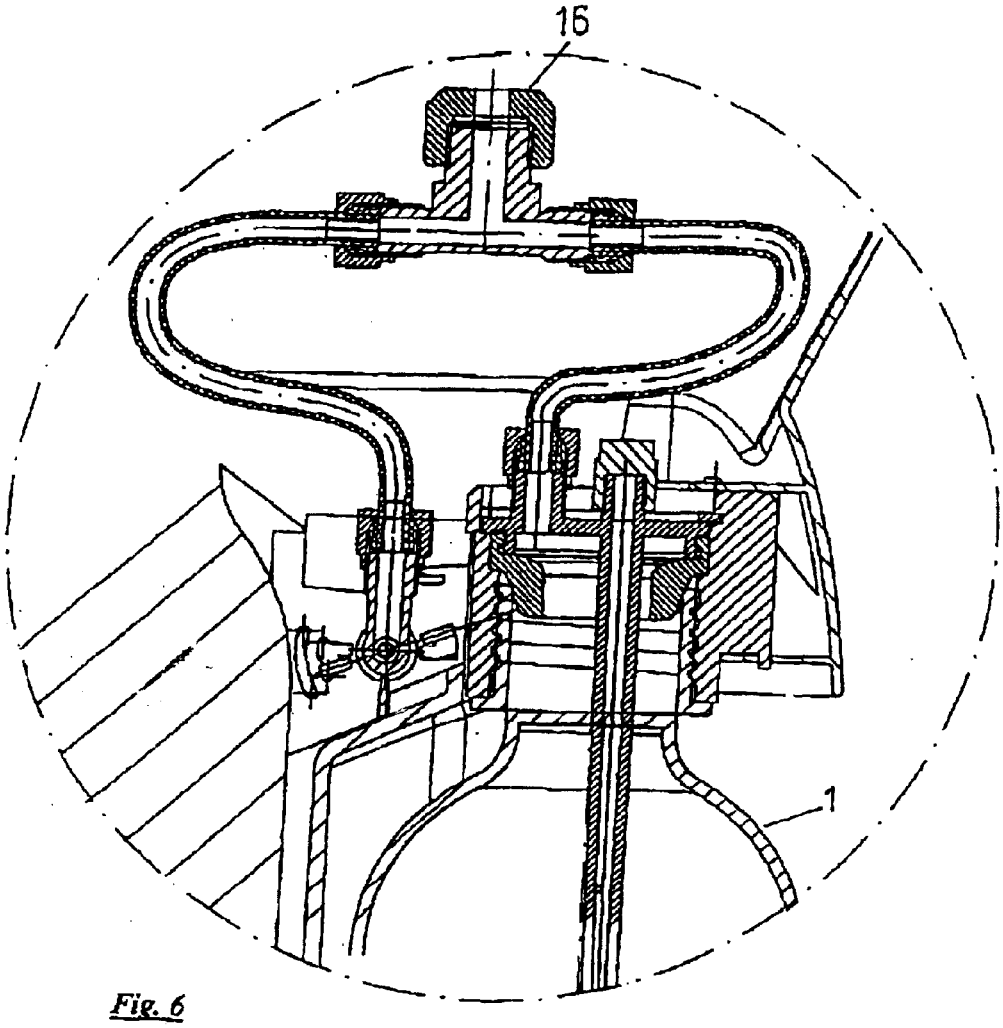
Figure 7:
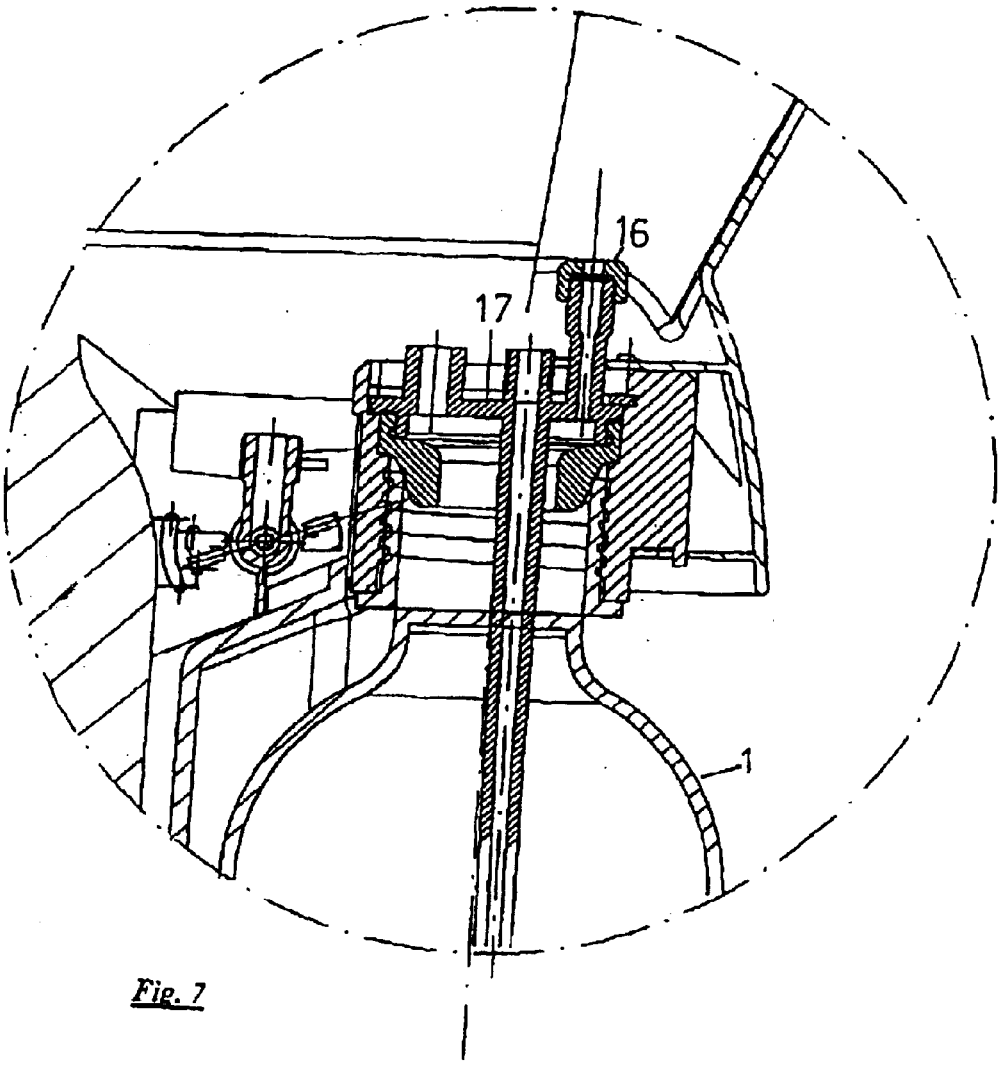

There is shown in:

FIG. 1 a view of the carbonating device in section,

FIG. 2 a view of the carbonating device in part-section,

FIGS. 3*a* and 3*b* the swivellable part of the filling device,

FIG. 4 the part of the filling device with the movable sliding blocks,

FIG. 5 a cut-out section of the carbonating device with a vessel with a predetermined fracture point, FIG. 6 a cut-out section of the carbonating device with a bursting disk in the connection line between the inside of the vessel and blow-off valve and FIG. 7 a cut-out section of the carbonating device with a bursting disk in the base of the filling device.

A carbonating device according to the invention is shown in FIG. 1. A suitable vessel 1, which contains the liquid to be gassed, is connected in sealed manner to the filling device 3. The carbonating device has a rear space 8 in which a pressure container 9 is arranged. A valve which can be opened or closed by the actuation button 2 is provided on the pressure container 9. To gas the liquid, only the actuation button 2 need be pressed. Gas then flows out of the pressure container 9 via the nozzle 18 into the vessel 1. The pressure increases and carbon dioxide dissolves in the liquid. The gassing process is ended by releasing the actuation button 2. It can clearly be seen that the nozzle 18 has a removable nozzle head 19. In addition, the rear space 8 is sealed by a rear part 10 which has a locking device 11. This locking device 11 is composed of a movable part 11 attached to the rear part 10 and, in the locked position, engages in the base of the carbonating device.

FIG. 2 shows a top view of the carbonating device, the rear space being shown in section. The blow-off or pressure-relief valve 12 which connects the inside of the vessel 1 to the rear space 8 can be clearly seen. If the pressure in the vessel increases too much, the blow-off valve opens and the excess pressure is blown into the rear space 12. As already described above, under certain circumstances, liquid can emerge from the blow-off valve. Therefore, a collecting device 14 is provided in the rear space underneath the blow-off valve 12. Any liquid which emerges drops into the collecting device 14 and can be removed together with the collecting device 14 from the carbonating device as required.

The locking device 11 can be clearly seen in FIG. 2. The rear part 10 can be removed from the rear space when the locking device 11 is moved into the opened position. When closing the rear space with the rear part, the process is reversed.

The swivellable part of the filling device 3 is shown in FIGS. 3*a* and 3*b*. The filling device has two positions. The swivelled position 4, in which the filling device and optionally the vessel is swivelled out of the vertical, and also the second position 5, in which the filling device and vessel are in a vertical position. The filling device is swivellably housed about the axis 6 with the help of a trunnion. The movable part of the filling device has at least one projection which, in the swivelled position, engages in the hole 17. This ensures that the filling device remains or locks in the swivelled position.

FIG. 4 shows a perspective view of a part which is swivelled together with the filling device. The sliding blocks 13 are arranged such that they press on the actuation device of the blow-off valves during the swivel process so that the blow-off valves are opened in the swivelled position. The movable sliding blocks ensure that the blow-off valves are closed in the vertical position of the filling device.

FIG. 5 shows a cut-out section of the carbonating device in which the vessel 1 can be seen which is connected to the filling device 3. Near the inlet the vessel 1 has a predetermined fracture point 15 which is intended to break open in the case of an excess pressure in the inside of the vessel.

An alternative version of such a predetermined fracture point is shown in FIG. 6. Here, a bursting disk 16, which is intended to burst in the case of too high a pressure, is arranged in the connection tube between the inside of the vessel and blow-off valves.

Alternatively, the bursting disk 16 can also be arranged in the base 17 of the filling device, as shown in FIG. 7.

Although the features shown individually achieve the object according to the invention, naturally they can be used combined in any way.

The present invention thus has a range of advantages compared with existing carbonating devices.

What is claimed is:

1. A carbonating device for loading a liquid with a pressurized gas, with a filling device which can be connectedly sealed to a vessel containing the liquid, the filling device having a filling valve and actuation elements for this purpose with which the connection between the inside of the vessel and the pressurized section of the filling device can be established, wherein at least one part of the filling device is swivellable so that, in a first position of the filling device, the latter can be connected to the vessel and, in a second position of the filling device, the connection between the inside of the vessel and the pressurized section of the filling device can be established, the filling device being lock-able in the first position.

2. The carbonating device according to claim 1, wherein the filling device is pre-tensioned, preferably elastically, into the second position.

3. The carbonating device according to of claim 1, wherein at least one device is provided which, in the first position of the filling device, prevents the actuation of the actuation elements of the valve and/or, in the second position of the filling device prevents the connection or detachment of the vessel to or from the filling device.

4. The carbonating device according to claim 1, wherein the device has a rear space for housing a pressure container in which the gas to be dissolved in the liquid is stored under pressure, and the rear space can be sealed by a rear part with the help of a locking device, the locking device having a movable part which is attached to the rear part and the movable part having a first position in which the locking device is closed, and a second position in which the locking device is opened, the locking device preferably not being pre-tensioned into the first position.

5. The carbonating device according to claim 4, wherein the movable part of the locking device is essentially a bar or slide which, in the locked position, engages behind a wall or in the base of the rear space.

6. The carbonating device according to claims 1, wherein the carbonating device has at least one blow-off valve which, when the vessel is connected to the filling device can connect the inside of the vessel to the outside, and a blow-off device is provided which opens at least one blow-off valve when the filling device passes from the first into the second position, at least one blow-off valve mounted securely in the device being actuated by moving sliding blocks when the filling device passes from the first into the second position.

7. The carbonating device according to claim 1, wherein at least two pressure-relief valves are provided which are opened when the filling device passes from the first into the second position.

8. The carbonating device according to claim 7, wherein the pressure-relief valves are arranged such that the inside of the vessel can be connected by them to the rear space of the carbonating device.

9. The carbonating device according to claim 6, wherein a collecting device is provided for the gas-liquid mixture which emerges from the at least one blow-off valve under certain circumstances.

10. The carbonating device according to claim 9, wherein the collecting device can be removed.

11. The carbonating device according to claim 9, wherein each said blow-off valve is provided with its own collecting device.

12. The carbonating device according to claim 10, wherein the collecting device is essentially secured against horizontal movement.

13. The carbonating device according to claim 1, wherein, in the volume which is formed by the vessel and parts of the filling device in sealed-off state, a bursting disk or a pre-determined fracture point is provided.

14. The carbonating device according to claim 13, wherein the vessel has a pre-determined fracture point.

15. The carbonated device according to claim 14, wherein the pre-determined fracture point is arranged in the region of the vessel neck near the filling opening.

16. The carbonating device according to claim 6, wherein a bursting disk is provided in the connection between the filling device and the blow-off valve.

17. The carbonating device according to claim 13, wherein a bursting disk is provided in the base of the filling device.

18. The carbonating device according to claim 1, wherein the filling device has a nozzle which projects into the vessel during the gassing of the liquid, the nozzle being removable.

19. The carbonating device according to claim 1, wherein carbon dioxide is provided as gas.

* * * * *

UNITED STATES PATENT AND TRADEMARK OFFICE

CERTIFICATE OF CORRECTION

PATENT NO. : 6,742,772 B2
DATED : June 1, 2004
INVENTOR(S) : Kiefer

It is certified that error appears in the above-identified patent and that said Letters Patent is hereby corrected as shown below:

Column 1,
Lines 14 and 20, “connected sealed” should be -- connectedly sealed --

Column 6,
Line 14, “hole 17” should read -- holes 7. --

Signed and Sealed this

Seventh Day of December, 2004

JON W. DUDAS
*Director of the United States Patent and Trademark Office*